US008347787B1

(12) United States Patent
Stowe et al.

(10) Patent No.: US 8,347,787 B1
(45) Date of Patent: Jan. 8, 2013

(54) VARIABLE DATA LITHOGRAPHY APPARATUS EMPLOYING A THERMAL PRINTHEAD SUBSYSTEM

(75) Inventors: Timothy Stowe, Alameda, CA (US); Steven Moore, Pittsford, NY (US)

(73) Assignees: Palo Alto Research Center Incorporated, Palo Alto, CA (US); Xerox Corporation, Norwalk, CT (US)

( * ) Notice: Subject to any disclaimer, the term of this patent is extended or adjusted under 35 U.S.C. 154(b) by 40 days.

(21) Appl. No.: 13/204,578

(22) Filed: Aug. 5, 2011

(51) Int. Cl.
*B41C 1/10* (2006.01)

(52) U.S. Cl. ..... 101/450.1; 101/451; 101/467; 101/470

(58) Field of Classification Search ..... 101/467, 101/470, 468, 130, 450.1, 451
See application file for complete search history.

(56) References Cited

U.S. PATENT DOCUMENTS

| | | | | |
|---|---|---|---|---|
| 3,741,118 | A | 6/1973 | Carley | |
| 3,800,699 | A | 4/1974 | Carley | |
| 3,877,372 | A | 4/1975 | Leeds | |
| 4,627,349 | A | 12/1986 | Claussen | |
| 4,887,528 | A | 12/1989 | Ruge | |
| 5,067,404 | A | 11/1991 | Frunder et al. | |
| 5,701,815 | A | 12/1997 | Bocko | |
| 5,855,173 | A | 1/1999 | Chatterjee et al. | |
| 6,125,756 | A | 10/2000 | Nussel et al. | |
| 6,146,798 | A | 11/2000 | Bringans et al. | |
| 6,318,264 | B1 | 11/2001 | D'Heureuse et al. | |
| 6,561,090 | B1 | 5/2003 | Spooner | |
| 6,725,777 | B2 | 4/2004 | Katano | |
| 6,841,366 | B1 | 1/2005 | Bower et al. | |
| 6,901,853 | B2 | 6/2005 | Baldy et al. | |
| 7,020,355 | B2 | 3/2006 | Lahann et al. | |
| 7,061,513 | B2 | 6/2006 | Katano et al. | |
| 7,100,503 | B2 | 9/2006 | Wiedemer et al. | |
| 7,191,705 | B2 | 3/2007 | Berg et al. | |
| 8,011,781 | B2 * | 9/2011 | Taniuchi et al. | 347/103 |
| 8,053,168 | B2 * | 11/2011 | Daniel et al. | 430/300 |
| 2003/0167950 | A1 | 9/2003 | Mori | |
| 2004/0011234 | A1 | 1/2004 | Figov | |
| 2005/0178281 | A1 | 8/2005 | Berg et al. | |
| 2005/0258136 | A1 | 11/2005 | Kawanishi | |
| 2006/0152566 | A1 | 7/2006 | Taniuchi | |
| 2007/0199457 | A1 | 8/2007 | Cyman, Jr. et al. | |

(Continued)

FOREIGN PATENT DOCUMENTS

DE 101 60 734 A1 7/2002

(Continued)

OTHER PUBLICATIONS

U.S. Appl. No. 13/095,714, filed Apr. 27, 2011, Stowe et al.

(Continued)

*Primary Examiner* — Huan Tran
(74) *Attorney, Agent, or Firm* — Jonathan A. Small

(57) ABSTRACT

A printhead subsystem is disclosed for selectively removing portions of a layer of dampening fluid disposed over an arbitrarily reimageable surface in a variable data lithographic system. The subsystem comprises a thermal printhead element disposed proximate the arbitrarily reimageable surface, and driving circuitry communicatively connected to the thermal printhead for selectively temporarily heating the thermal printhead to an elevated temperature. Portions of the dampening fluid layer proximate the thermal printhead are vaporized and driven off the arbitrarily reimageable surface by the thermal printhead when the thermal printhead is at the elevated temperature, to thereby form voids in the dampening fluid layer.

21 Claims, 8 Drawing Sheets

U.S. PATENT DOCUMENTS

| | | | |
|---|---|---|---|
| 2007/0199458 | A1 | 8/2007 | Cyman, Jr. et al. |
| 2007/0199459 | A1 | 8/2007 | Cyman, Jr. et al. |
| 2007/0199460 | A1 | 8/2007 | Cyman, Jr. et al. |
| 2007/0199461 | A1 | 8/2007 | Cyman, Jr. et al. |
| 2007/0199462 | A1 | 8/2007 | Cyman, Jr. et al. |
| 2008/0011177 | A1 | 1/2008 | Muraoka |
| 2008/0032072 | A1 | 2/2008 | Taniuchi |
| 2008/0223240 | A1 | 9/2008 | Drury |
| 2010/0031838 | A1 | 2/2010 | Lewis et al. |

FOREIGN PATENT DOCUMENTS

| | | | |
|---|---|---|---|
| DE | 103 60 108 | A1 | 7/2004 |
| DE | 10 2006 050744 | A1 | 4/2008 |
| DE | 10 2008 062741 | | 7/2010 |
| EP | 1 935 640 | A2 | 6/2008 |
| EP | 1 938 987 | A2 | 7/2008 |
| EP | 1 964 678 | A2 | 9/2008 |
| EP | 11187189.3 | | 10/2011 |
| EP | 11187190.1 | | 10/2011 |
| EP | 11187191.9 | | 10/2011 |
| EP | 11187192.7 | | 10/2011 |
| EP | 11187193.5 | | 10/2011 |
| EP | 11187195.0 | | 10/2011 |
| EP | 11187196.8 | | 10/2011 |
| WO | 2006/133024 | A2 | 12/2006 |
| WO | WO 2009025821 | A1 | 2/2009 |

OTHER PUBLICATIONS

U.S. Appl. No. 13/095,737, filed Apr. 27, 2011, Stowe et al.
U.S. Appl. No. 13/095,745, filed Apr. 27, 2011, Stowe et al.
U.S. Appl. No. 13/095,757, filed Apr. 27, 2011, Stowe et al.
U.S. Appl. No. 13/095,764, filed Apr. 27, 2011, Stowe et al.
U.S. Appl. No. 13/095,773, filed Apr. 27, 2011, Stowe et al.
U.S. Appl. No. 13/095,778, filed Apr. 27, 2011, Stowe et al.
U.S. Appl. No. 13/204,515, filed Aug. 5, 2011, Stowe et al.
U.S. Appl. No. 13/204,526, filed Aug. 5, 2011, Stowe et al.
U.S. Appl. No. 13/204,548, filed Aug. 5, 2011, Pattekar et al.
U.S. Appl. No. 13/204,560, filed Aug. 5, 2011, Stowe et al.
U.S. Appl. No. 13/204,567, filed Aug. 5, 2011, Stowe et al.
U.S. Appl. No. 13/366,947, filed Feb. 6, 2012, Biegelsen.
U.S. Appl. No. 13/426,209, filed Mar. 21, 2012, Liu et al.
U.S. Appl. No. 13/426,262, filed Mar. 21, 2012, Liu et al.
Shen et al., "A new understanding on the mechanism of fountain solution in the prevention of ink transfer to the non-image area in conventional offset lithography", J. Adhesion Sci. Technol., vol. 18, No. 15-16, pp. 1861-1887 (2004).
Katano et al., "The New Printing System Using the Materials of Reversible Change of Wettability", International Congress of Imaging Science 2002, Tokyo, pp. 297 et seq. (2002).

* cited by examiner

VARIABLE DATA LITHOGRAPHY APPARATUS EMPLOYING A THERMAL PRINTHEAD SUBSYSTEM

CROSS-REFERENCE TO RELATED APPLICATIONS

The present disclosure is related to U.S. Patent Application titled "Variable Data Lithographic System", Ser. No. 13/095,714, filed on Apr. 27, 2011, and assigned to the same assignee as the present application, and further which is incorporated herein by reference.

BACKGROUND

The present disclosure is related to marking and printing systems, and more specifically to variably data lithography system employing an edge-writing thermal print head.

Offset lithography is a common method of printing today. (For the purposes hereof, the terms "printing" and "marking" are interchangeable.) In a typical lithographic process a printing plate, which may be a flat plate, the surface of a cylinder, or belt, etc., is formed to have "image regions" formed of hydrophobic and oleophilic material, and "non-image regions" formed of a hydrophilic material. The image regions are regions corresponding to the areas on the final print (i.e., the target substrate) that are occupied by a printing or marking material such as ink, whereas the non-image regions are the regions corresponding to the areas on the final print that are not occupied by said marking material. The hydrophilic regions accept and are readily wetted by a water-based fluid, commonly referred to as a fountain solution (typically consisting of water and a small amount of alcohol as well as other additives and/or surfactants to reduce surface tension). The hydrophobic regions repel fountain solution and accept ink, whereas the fountain solution formed over the hydrophilic regions forms a fluid "release layer" for rejecting ink. Therefore the hydrophilic regions of the printing plate correspond to unprinted areas, or "non-image areas", of the final print.

The ink may be transferred directly to a substrate, such as paper, or may be applied to an intermediate surface, such as an offset (or blanket) cylinder in an offset printing system. The offset cylinder is covered with a conformable coating or sleeve with a surface that can conform to the texture of the substrate, which may have surface peak-to-valley depth somewhat greater than the surface peak-to-valley depth of the imaging plate. Also, the surface roughness of the offset blanket cylinder helps to deliver a more uniform layer of printing material to the substrate free of defects such as mottle. Sufficient pressure is used to transfer the image from the offset cylinder to the substrate. Pinching the substrate between the offset cylinder and an impression cylinder provides this pressure.

Typical lithographic and offset printing techniques utilize plates which are permanently patterned, and are therefore useful only when printing a large number of copies of the same image (long print runs), such as magazines, newspapers, and the like. However, they do not permit creating and printing a new pattern from one page to the next without removing and replacing the print cylinder and/or the imaging plate (i.e., the technique cannot accommodate true high speed variable data printing wherein the image changes from impression to impression, for example, as in the case of digital printing systems). Furthermore, the cost of the permanently patterned imaging plates or cylinders is amortized over the number of copies. The cost per printed copy is therefore higher for shorter print runs of the same image than for longer print runs of the same image, as opposed to prints from digital printing systems.

Accordingly, a lithographic technique, referred to as variable data lithography, has been developed which uses a non-patterned reimageable surface coated with dampening fluid. Regions of the dampening fluid are removed by exposure to a focused radiation source (e.g., a laser light source). A temporary pattern in the dampening fluid is thereby formed over the non-patterned reimageable surface. Ink applied thereover is retained over the surface in areas formed by the removal of the dampening fluid. The dampening fluid may then be removed, a new, uniform layer of dampening fluid applied to the reimageable surface, and the process repeated.

According to known systems, the patterning of dampening fluid on the reimageable surface in variable data lithography essentially involves using a laser to selectively boil off or ablate the dampening fluid in selected locations. This process can be energy intensive due to the large latent heat of vaporization of water. At the same time, high-speed printing necessitates the use of high-speed modulation of the laser source, which can be prohibitively expensive for high power lasers. Furthermore, the vaporized dampening fluid produces a "cloud" which may absorb laser energy and otherwise interfere with the laser patterning process. Still further, laser-based optical systems are relatively large, leading to relatively large marking systems. And laser writing systems require scanning and focusing optics which are susceptible to alignment inaccuracies affecting writing to the dampening fluid and ultimately affecting print quality.

SUMMARY

Accordingly, the present disclosure is directed to systems and methods for providing variable data lithographic and offset lithographic printing, which address the shortcomings identified above—as well as others as will become apparent from this disclosure. The present disclosure concerns improvements to various aspects of variable imaging lithographic marking systems based upon variable patterning of dampening solutions and methods previously discussed.

According to a first aspect of the disclosure, a reimageable layer of an imaging member, which may be a drum, plate, belt, or the like, is provided. In one embodiment, the reimageable layer comprises a reimageable outermost surface, for example composed of the class of materials commonly referred to as silicone (e.g., polydimethylsiloxane). A thermal print head is disposed proximate the reimageable layer, following (in the direction of motion of the reimageable layer) a subsystem for applying the dampening fluid to the reimageable layer. In one embodiment, the thermal print head configured to write from a proximate edge thereof so as to minimize impact on the dampening fluid other than at points at which removal is desired.

In one embodiment, a printhead subsystem for selectively removing portions of a layer of dampening fluid disposed over an arbitrarily reimageable surface in a variable data lithographic system is disclosed that comprises a thermal printhead element disposed proximate the arbitrarily reimageable surface, and driving circuitry communicatively connected to the thermal printhead for selectively temporarily heating the thermal printhead to an elevated temperature. Portions of the dampening fluid layer proximate the thermal printhead edge are vaporized and driven off the arbitrarily reimageable surface by the thermal printhead when the thermal printhead is at the elevated temperature, to thereby form regions on the reimageable surface free from being covered by the dampening fluid layer.

In another embodiment, a variable data lithography system comprises: an imaging member comprising an arbitrarily reimageable surface layer; a dampening fluid subsystem for applying a dampening fluid layer to the arbitrarily reimageable surface layer; a patterning subsystem, including a thermal printhead element disposed proximate the arbitrarily reimageable surface layer and driving circuitry communicatively connected to the thermal printhead for selectively temporarily heating the thermal printhead to an elevated temperature whereby portions of the dampening fluid layer proximate the thermal printhead are vaporized and driven off the arbitrarily reimageable surface layer by the thermal printhead when the thermal printhead is at the elevated temperature, to thereby form regions with voids in the dampening fluid layer; an inking subsystem for applying ink over the arbitrarily reimageable surface layer such that the ink selectively adheres to the regions on the reimageable surface without the dampening fluid release layer to thereby produce an inked latent image; an image transfer subsystem for transferring the inked latent image to a substrate; and a cleaning subsystem for removing said dampening fluid layer and said ink. The imaging member and the patterning, inking, image transfer, and cleaning subsystems move relative to one another such that the arbitrarily reimageable surface layer is cleaned by the cleaning subsystem and a new dampening fluid layer is applied thereover by the dampening fluid subsystem.

The above is a summary of a number of the unique aspects, features, and advantages of the present disclosure. However, this summary is not exhaustive. Thus, these and other aspects, features, and advantages of the present disclosure will become more apparent from the following detailed description and the appended drawings, when considered in light of the claims provided herein.

BRIEF DESCRIPTION OF THE DRAWINGS

In the drawings appended hereto like reference numerals denote like elements between the various drawings. While illustrative, the drawings are not drawn to scale. In the drawings.

DETAILED DESCRIPTION

We initially point out that description of well-known starting materials, processing techniques, components, equipment and other well-known details are merely summarized or are omitted so as not to unnecessarily obscure the details of the present invention. Thus, where details are otherwise well known, we leave it to the application of the present invention to suggest or dictate choices relating to those details.

Figure 1:
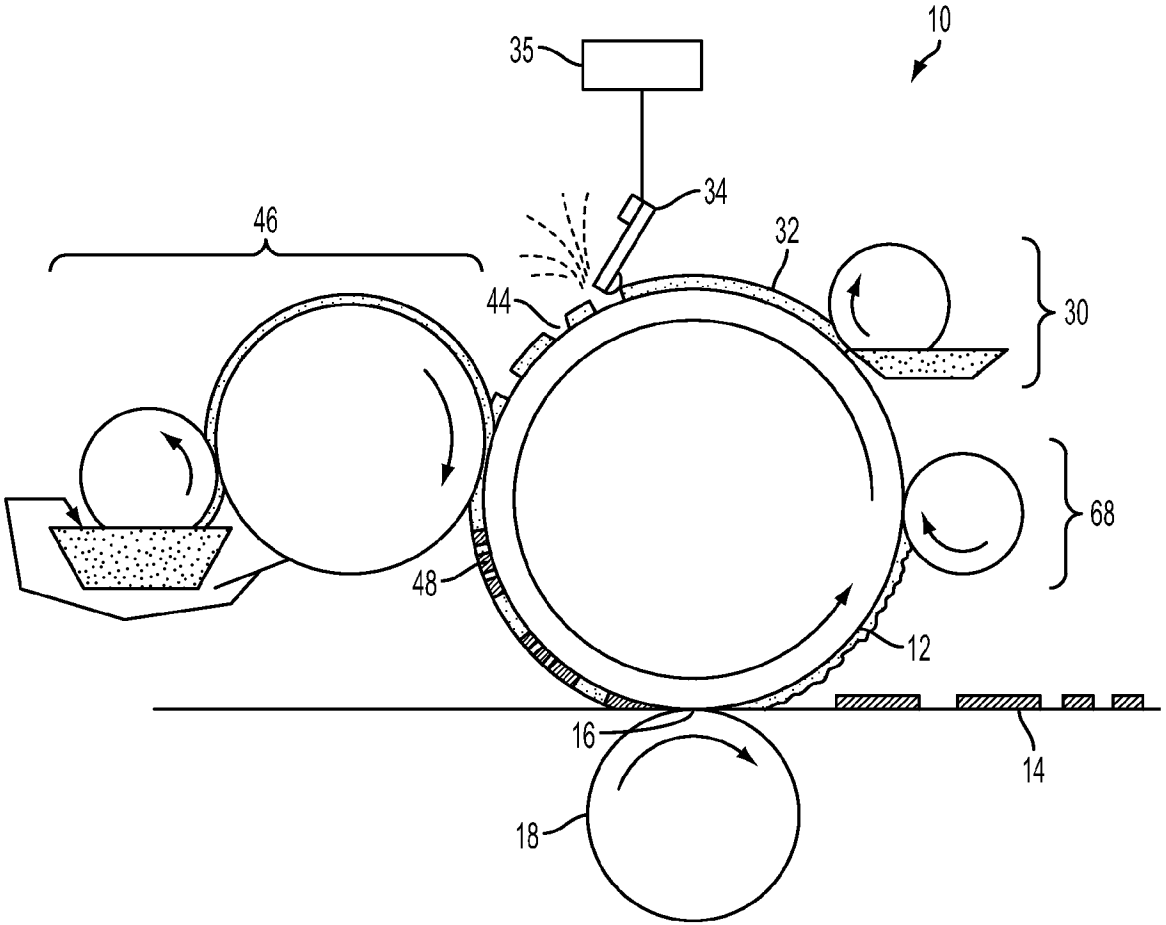
FIG. 1 is a side view of a first embodiment of a system for variable lithography, including a thermal printhead subsystem, according to the present disclosure.

With reference to FIG. 1, there is shown therein a first embodiment of a system 10 for variable lithography according to the present disclosure. System 10 comprises an imaging member 12, in this embodiment a drum, but may equivalently be a plate, belt, etc., surrounded by a number of subsystems. Imaging member 12 applies an ink image to substrate 14 at nip 16 where substrate 14 is pinched between imaging member 12 and an impression roller 18 in an image transfer subsystem. A wide variety of types of substrates, such as paper, plastic or composite sheet film, ceramic, glass, etc. may be employed. For clarity and brevity of this explanation we assume the substrate is paper, with the understanding that the present disclosure is not limited to that form of substrate. For example, other substrates may include cardboard, corrugated packaging materials, wood, ceramic tiles, fabrics (e.g., clothing, drapery, garments and the like), transparency or plastic film, metal foils, etc. A wide latitude of marking materials may be used including those with pigment densities greater than 10% by weight including but not limited to metallic inks or white inks useful for packaging. For clarity and brevity of this portion of the disclosure we generally use the term ink, which will be understood to include the range of marking materials such as inks, pigments, and other materials that may be applied by systems and methods disclosed herein.

The inked image from imaging member 12 may be applied to a wide variety of substrate formats, from small to large, without departing from the present disclosure. In one embodiment, imaging member 12 is at least 29 inches wide so that standard 4-sheet signature page or larger media format may be accommodated. The diameter of imaging member 12 must be large enough to accommodate various subsystems around its peripheral surface. In one embodiment, imaging member 12 has a diameter of 10 inches, although larger or smaller diameters may be appropriate depending upon the application of the present disclosure.

Figure 2A:
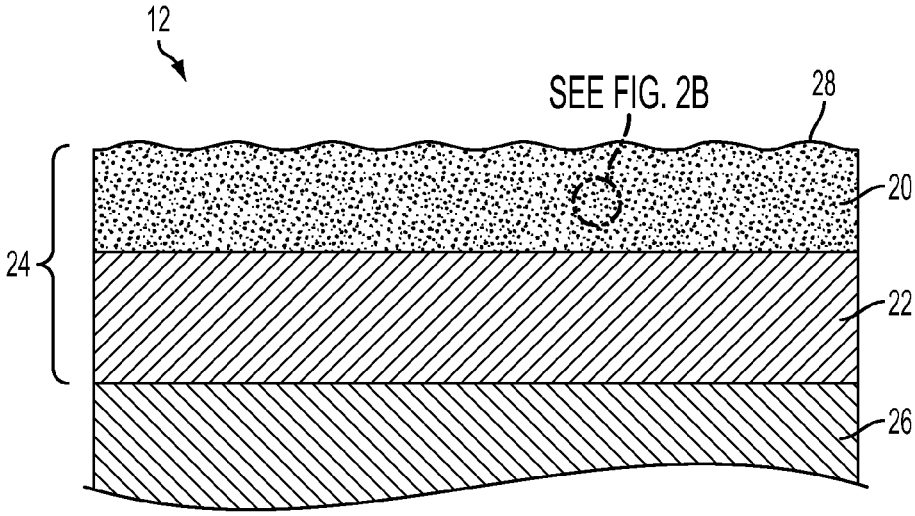
FIGS. 2A and 2B are a cross-section and magnified view, respectively, of a portion of an imaging member including a reimageable surface layer, according to the present disclosure.
Figure 2B:
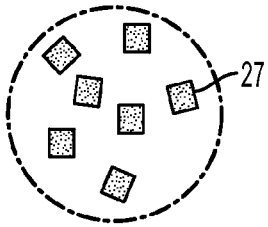

With reference to FIGS. 2A and 2B, a portion of imaging member 12 is shown in cross-section. In one embodiment, imaging member 12 comprises a thin reimageable surface layer 20 formed over an intermediate layer 22 (for example metal, ceramic, plastic, etc.), which together form a reimaging portion 24 that forms a rewriteable printing blanket. Intermediate layer 22 may be electrically insulating (or conducting), thermally insulating (or conducting), have variable compressibility and durometer, and so forth. For the purposes of the following discussion, it will be assumed that reimageable portion 24 is carried by cylinder core 26, although it will be understood that many different arrangements, as discussed above, are contemplated by the present disclosure.

Reimageable surface layer 20 should have a weak adhesion force to the ink at the interface yet good oleophilic wetting properties with the ink, to promote uniform (free of pinholes, beads or other defects) inking of the reimageable surface and to promote the subsequent forward transfer lift off of the ink onto the substrate. Silicone is one material having this property. In terms of providing adequate wetting of dampening solutions (such as water-based fountain fluid), the silicone surface need not be hydrophilic but in fact may be hydrophobic because wetting surfactants, such as silicone glycol copolymers, may be added to the dampening solution to allow the dampening solution to wet the silicone surface.

It will therefore be understood that while a water-based solution is one embodiment of a dampening solution that may be employed in the embodiments of the present disclosure, other non-aqueous dampening solutions with low surface tension, that are oleophobic, are vaporizable, decomposable, or otherwise selectively removable, etc. may be employed. One such class of fluids is the class of HydroFluoroEthers (HFE), such as the Novec brand Engineered Fluids manufactured by 3M of St. Paul, Minn. These fluids have numerous beneficial properties, including in light of the current disclosure the following: (1) much lower heat of vaporization than water, which translates into lower required local vaporization power; (2) lower heat capacity, which also translates into lower required local vaporization power; and, (3) vapor pressure and boiling point can be engineered, which in addition to lower required power can also translate into an improved robustness of a spatially selective forced evaporation process.

Returning to FIG. 1, disposed at a first location around imaging member 12 is dampening fluid subsystem 30. Dampening fluid subsystem 30 generally comprises one or more rollers, spray devices, metering blades, fluid reservoirs, and so forth (referred to as a dampening unit) for uniformly forming a dampening fluid layer 32 over imaging member 12. It is well known that many different types and configurations of dampening units exist for delivering layer 32 of dampening fluid having a uniform and controllable thickness. In one embodiment layer 32 is in the range of 0.2 μm to 1.0 μm, and very uniform without pin holes.

Following formation of layer 32 over imaging member 12, a latent print pattern is formed in layer 32 by selectively vaporizing regions thereof using thermal printhead subsystem 34. It will be appreciated that details regarding driving circuitry 35 controlling thermal printhead subsystem 34 are beyond the scope of the present disclosure, but that embodiments for such driving circuitry will be available to one skilled in the art.

Figure 3:
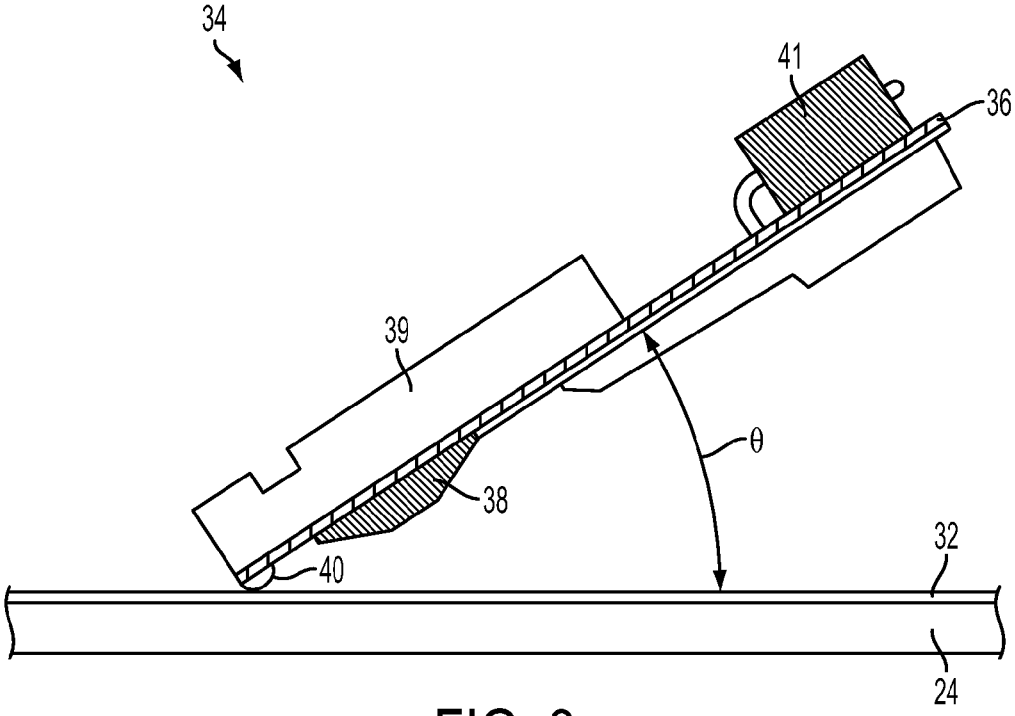
FIG. 3 is side view of a thermal printhead subsystem, according to the present disclosure.

With reference next to FIG. 3, there is shown therein a side view of an embodiment of thermal printhead subsystem 34. It will be appreciated that many different embodiments of a thermal printhead subsystem may provide the functionality disclosed herein, and the description of subsystem 34 is illustrative and limited only by the scope of the claims appended hereto. Printhead 34 comprises a substrate 36 carrying a driver circuit 38 communicatively coupled to a heating element 40. Optionally, driver circuitry may be formed and carried separate from substrate 36. Substrate 36 is typically made from a high thermal conductivity ceramic material that can efficiently carry away excess heat away from the head heaters at 40 to a metal heat sink 39. Other circuitry, mechanical elements such as 41, and mounting components may also be carried by substrate 36.

Figure 4:
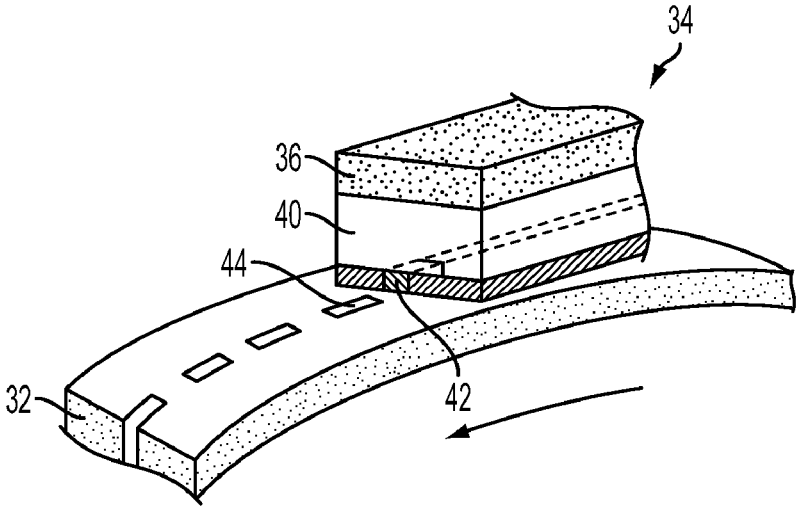
FIG. 4 is a cut-away perspective view of a thermal printhead subsystem disposed proximate a dampening fluid layer, according to the present disclosure.

In the embodiment depicted in FIG. 1 and FIG. 3, thermal printhead 34 is in close proximity to the reimageable portion 24 such that it touches the dampening solution layer 32 formed thereover with low pressure in a wiper blade configuration having a shallow angle, θ. This configuration allows the fountain solution to act as a lubrication layer that helps to greatly increase the lifetime of the thermal printhead and reimageable surface by suppressing frictional wear. Whereas most conventional thermal printing heads use 125 to 256 current pulses to create a single grayscale pixel for photofinishing applications, in the arrangement in FIG. 3 (and as also shown in FIG. 4) only one single pulse is needed to remove by evaporation and/or ablation a single dot of dampening fluid. Such a dot of dampening fluid removed may correspond to a 600 dpi or 1200 dpi dot size. Because the thermal energy is transmitted within this dampening fluid downstream, thermal printhead 34 will be in contact with a lubricated reimageable surface upstream. It is also possible for the thermal printhead to work efficiently with a small air gap between the head and the dampening fluid of approximately 1 μm or less in spacing. This is readily done, but requires maintaining control over the positioning of the thermal printhead 34 relative to reimaging portion 24.

Referring next to FIG. 4, a perspective view of a portion of heating element 40 proximate dampening fluid layer 32 is shown. Heating element 40 is of a type referred to as an edge-writing element. In such an element, a current is passed through an electrically resistive element 42 disposed at or near the proximal end of thermal printhead subsystem 34. The resistance produces a local temperature increase at resistive element 42. The temperature increase is sufficient to vaporize a region of layer 32 to produce dry downstream regions for receiving ink or other marking material. In one example, heating element 40 may form a part of an off-the-self 1200 dpi thermal print head system, such as model G5067 from Kanematsu USA (http://www.printhead.com/products/). Designs for a full printhead may include a wide common ground electrode (not shown) on the backside of the substrate 36 to eliminate common voltage loading, such as for wide formats. Alternatively, printhead 34 may consist of a proprietary OEM design optimized for wide format and high speed evaporation of the dampening fluid.

Figure 5:
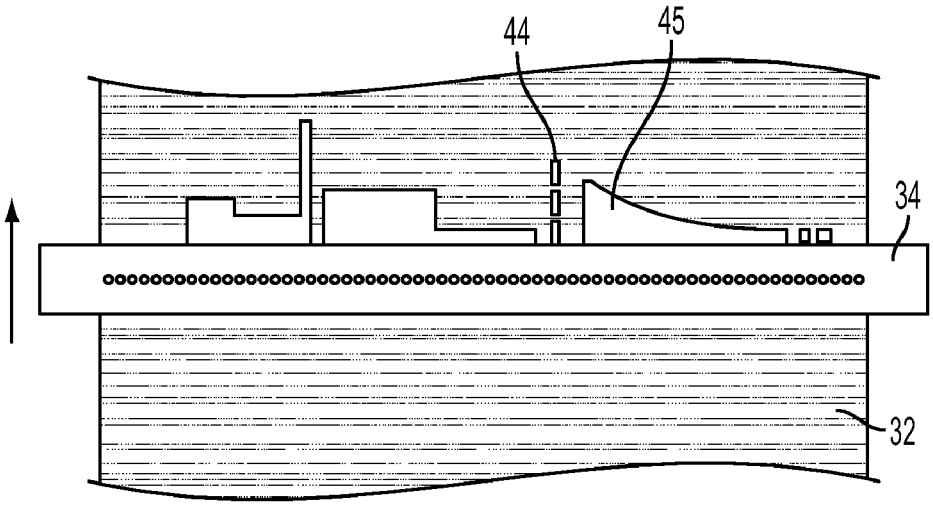
FIG. 5 is a top-view of a reimageable surface layer having a dampening fluid layer formed thereover and a thermal printhead selectively evaporating portions of the dampening fluid layer, according to the present disclosure.

It will be appreciated that FIG. 4 illustrates only a portion of heating element 40 sufficient to produce a single stripe of voids of dampening fluid, and that a complete thermal printhead will include multiple resistive elements arranged laterally across the end of the thermal printhead to produce multiple, parallel rows in order to build up a latent image, as illustrated in FIG. 5. Each heating element 40 must be closely spaced to its neighboring heating elements in order that the adjacent voids 44 of dampening solution will slightly overlap so as to form larger lateral regions 45 on the reimageable surface with no remaining dampening solution.

Due to the nature of the thermal printhead used in this embodiment, the outer wear layer used in most thermal printing head designs can be minimized in thickness to maximize thermal conductivity to the dampening fluid layer. In addition, the glaze layer used to planarize most of the ceramic substrates upon which the thermal printhead is built can also be minimized (i.e., be of the thin glaze variety) in order to maximize the cool down rate and thus also minimize the thermal response time of the thermal printhead. In certain embodiments, the temperatures near the resistive heating elements need only reach 100-130° C. Accordingly, power levels less than 100 mW per pixel are more than sufficient at fully removing thin layers of dampening fluid even at high speeds near 1 m/s.

Returning to FIG. 1, following patterning of the dampening fluid layer 32, an inker subsystem 46 is used to apply ink over the layer of dampening solution 32, preferentially in dry regions 44. Since the dampening fluid is oleophobic, and the ink composition hydrophobic, areas covered by dampening fluid naturally reject ink. The ink employed should have a relatively low viscosity in order to promote better filling of voids 44 and better adhesion to reimageable surface layer 20. This forms an inked latent image over reimageable surface layer 20. The inked latent image is then transferred to substrate 14 at nip 16.

Following transfer of the majority of the ink to substrate 14, any residual ink and residual dampening solution is removed from reimageable surface layer 20, preferably without scraping or wearing that surface. Cleaning subsystem 68, or other methods and systems, may be employed to clean the reimageable surface layer prior to reapplication of dampening fluid at dampening fluid subsystem 30 and formation of a new latent image in dampening fluid layer 32, as described above.

A system having a single imaging cylinder, without an offset or blanket cylinder, is shown and described herein. The reimageable surface layer is made from material that is conformal to the roughness of print media via a high-pressure impression cylinder, while it maintains good tensile strength necessary for high volume printing. Traditionally, this is the role of the offset or blanket cylinder in an offset printing system. However, requiring an offset roller implies a larger system with added maintenance and repair/replacement issues, and increased production cost, added energy consumption to maintain rotational motion of the drum (or alternatively a belt, plate or the like).

Figure 6:
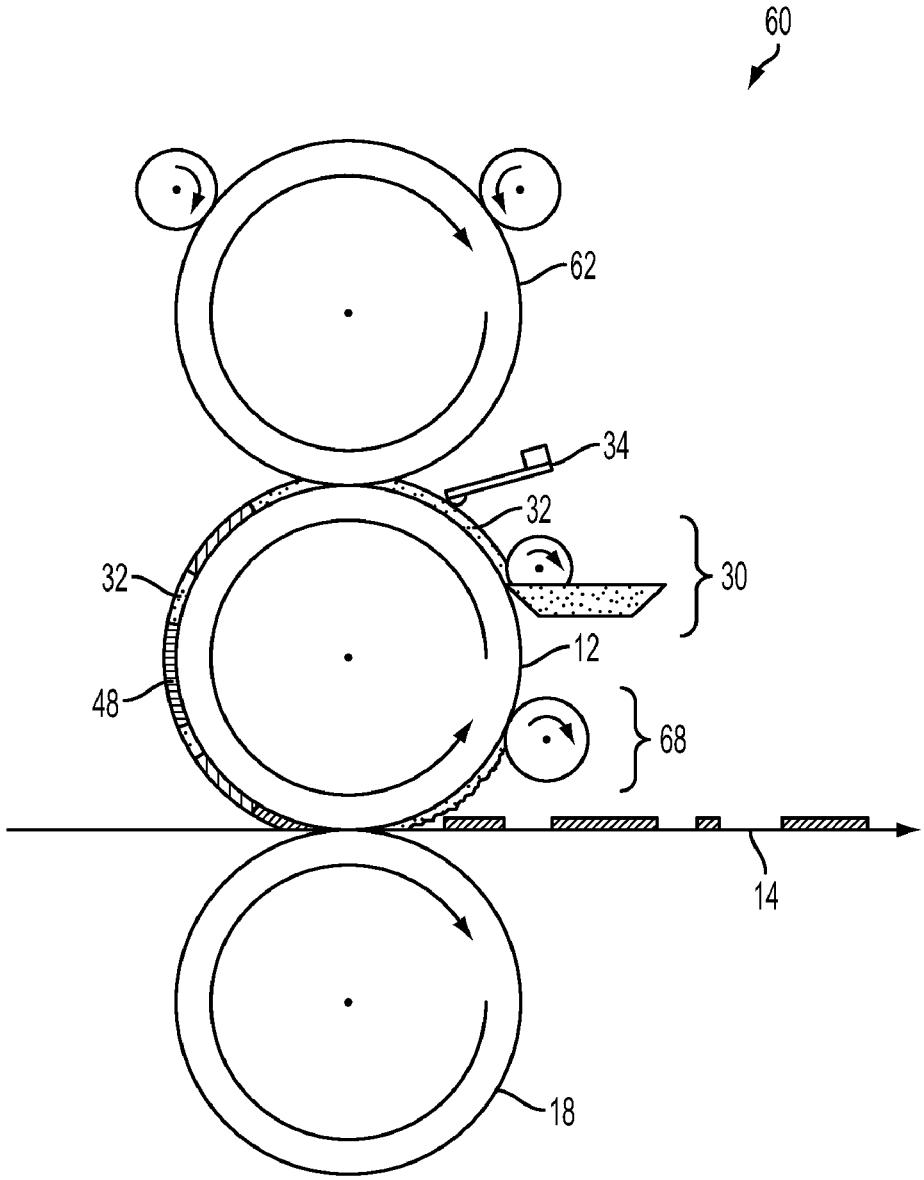
FIG. 6 is an illustration of an embodiment in which the offset cylinder of a traditional offset printing system is retrofitted with a thermal printhead subsystem, according to the present disclosure.

However, in some cases it may be advantageous to retrofit existing offset equipment with a variable data lithographic system that can fit around the blanket cylinder of such a traditional offset system. One embodiment 60 of such a retrofit is illustrated in FIG. 6. The top image plate cylinder 62 of a traditional offset printing apparatus may function as an inker system in which a constant background inked image is applied. The offset blanket cylinder of the traditional system may be retrofitted with a reimageable surface, and the thermal printhead 34, dampening fluid subsystem 30, cleaning subsystem 68, etc. be provided around the cylinder's circumference, very much in the manner shown and described with regard to FIG. 1. Operation of embodiment 60 is then consistent with operation of the embodiment 10 shown in FIG. 1.

In certain embodiments it is desired to provide elements of both a variable data lithography system using a thermal printhead, as described, as well as a traditional offset lithography system as otherwise well known. In such cases, for example, only small areas of variable data are necessary, while other areas repeat from one printing to the next. In such cases, the thermal write head and associated subsystems may be narrower than the total width of the printing system, covering only that area in which variable data printing is required. A non-reimageable surface having the print image formed therein may be disposed on the surface of top plate cylinder 62, which receives ink and transfers the inked image to the surface of imaging member 12, which in turn transfers the image to substrate 14 together with the inked latent image formed in dry regions in dampening solution layer 32. This arrangement allows full amortization of equipment already have purchased while providing the optional additional benefit of imprinting variable data into the static image before transfer to a substrate. It will be appreciated that similar arrangements may be used to provide variable data by retrofitting a flexographic printer or other similar print systems as will be appreciated by one skilled in the art.

Figure 7:
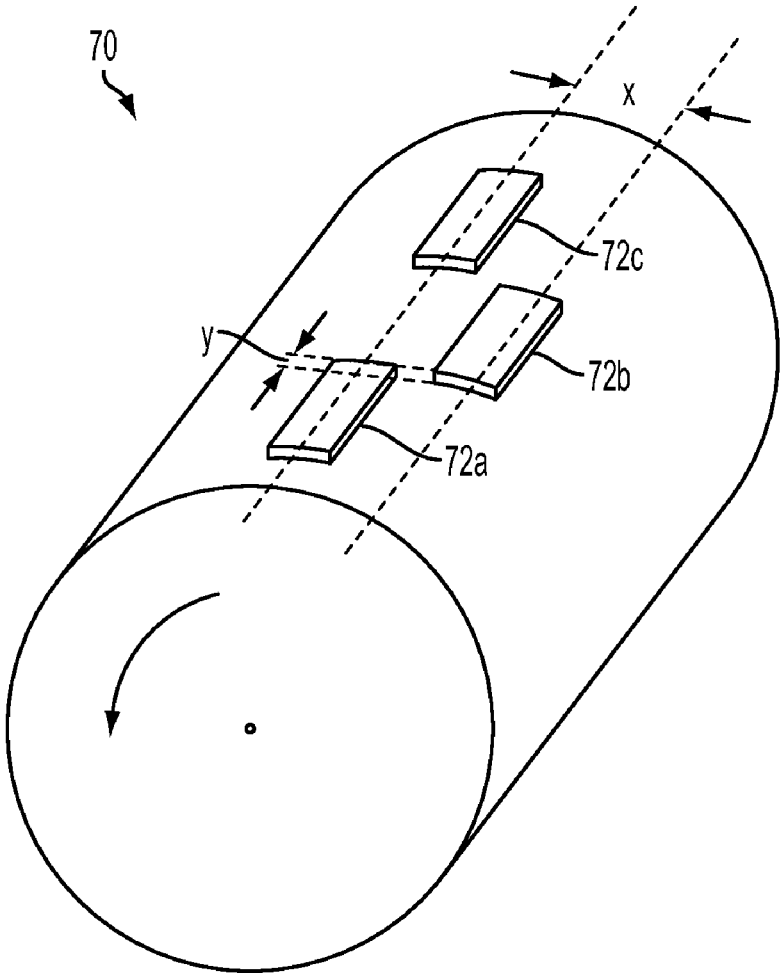
FIG. 7 is an illustration of a plurality of thermal printheads arranged to image a single reimageable surface, according to the present disclosure.

In certain embodiments, the thermal printheads disclosed above are arranged so as to form a continuous monolithic head over substantially the entire dampening layer width. However, in other embodiments, other arrangements are contemplated by this disclosure. For example, with reference to FIG. 7, an embodiment 70 is shown in which a plurality of narrow thermal print heads 72*a*, 72*b*, 72*c*, etc. are arranged, offset from one another by a distance x, into rows with a slight amount of overlap, y, to thereby form a continuous image over a wide swath.

Figure 8:
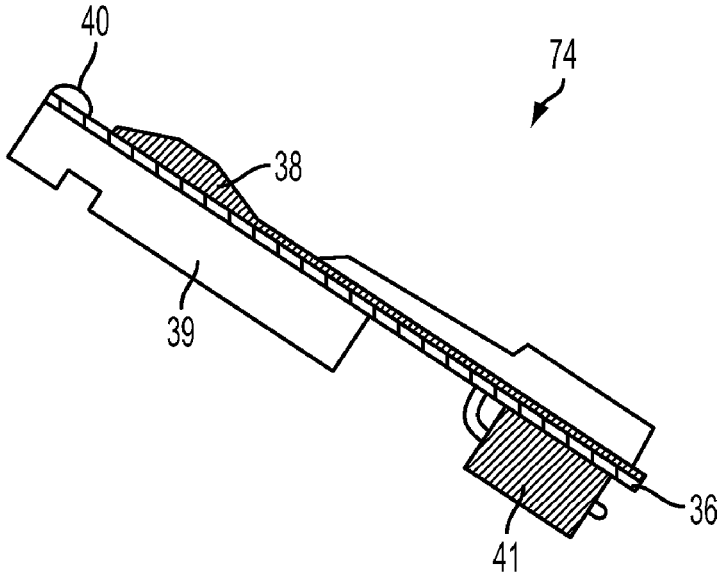
FIG. 8 is a side-view illustration of a thermal printhead of a type that may be disposed over the surface of a dampening fluid form roller to impart a pattern-wise transfer of dampening fluid onto the reimageable surface used in a variable data lithography system according to the present disclosure.
Figure 9:
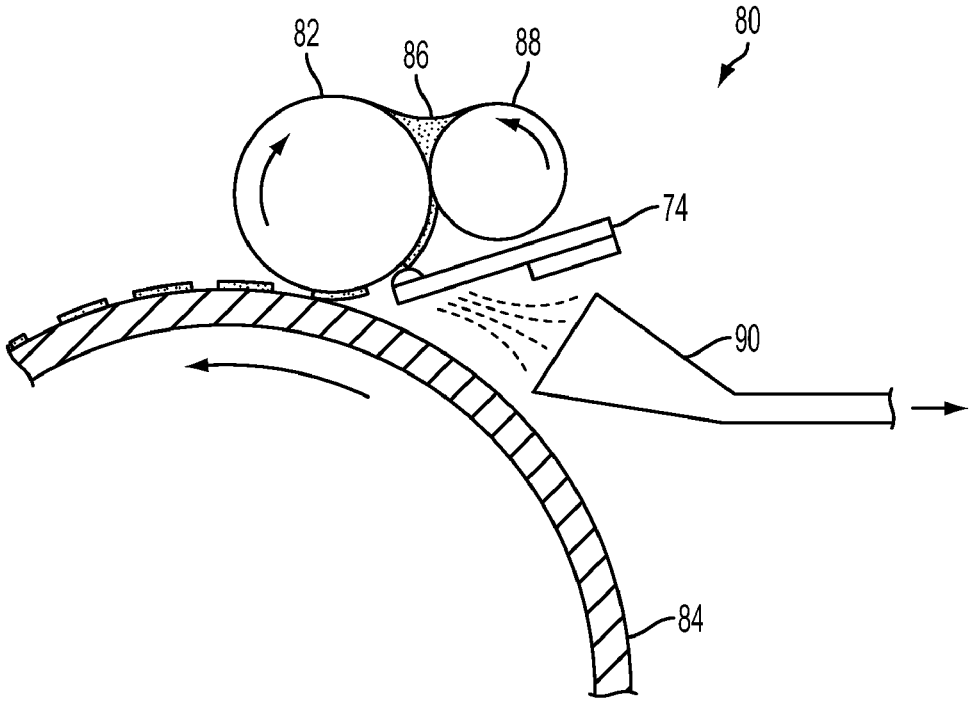
FIG. 9 is a side-view illustration of a thermal printhead disposed over the surface of a dampening fluid form roller to impart a pattern-wise transfer of dampening fluid onto the reimageable surface used in a variable data lithography system according to the present disclosure.

In some cases it may be desirable to pre-pattern the dampening solution before it is transferred to the reimageable surface by positioning the thermal print head over a dampening form roller. An embodiment of a printhead 74 for accomplishing this is illustrated in FIG. 8, and an embodiment 80 including printhead 74 operating in association with a dampening fluid form roller 82 and an imaging member 84 is illustrated in FIG. 9. In operation, a layer of dampening fluid 86 is applied to the surface of dampening fluid form roller 82. The dampening fluid form roller 82 operates in conjunction with other elements such as roller 88 to ensure that the layer of dampening fluid applied to the surface thereof is on uniform and desired thickness. This dampening fluid layer may be patterned, as previously described, by thermal printhead 74. Vaporized dampening fluid may be removed from the environment by a vacuum source 90 or the like (where is may be recondensed and recycled). A pattern of dampening fluid remains on the surface of roller 82. Roller 82 and imaging member 84 are disposed proximate one another such that the pattern of dampening fluid is transferred from the former to the latter. The dampening fluid layer may be made relatively thick to account for film split at the nip. This arrangement allows a thermal write head to be applied to a smaller diameter roller that may help facilitate the geometry of some thermal printhead designs. The arrangement has the benefit that the surface of the dampening form roller can be further optimized to reduce the wear of both the dampening form roller and thermal print head.

While it is contemplated by the present disclosure that an offset cylinder may be employed in a complete printing system, such need not be the case. Rather, the reimageable surface layer may instead be brought directly into contact with the substrate to affect a transfer of an ink image from the reimageable surface layer to the substrate. Component cost, repair/replacement cost, and operational energy requirements are all thereby reduced.

It should be understood that when a first layer is referred to as being "on" or "over" a second layer or substrate, it can be directly on the second layer or substrate, or on an intervening layer or layers may be between the first layer and second layer or substrate. Further, when a first layer is referred to as being "on" or "over" a second layer or substrate, the first layer may cover the entire second layer or substrate or a portion of the second layer or substrate.

The invention described herein, when operated according to the method described herein meets the standard of high ink transfer efficiency, for example greater than 95% and in some cases greater than 99% efficiency of transferring ink off of the imaging cylinder and onto the substrate. In addition, the disclosure teaches combining the functions of the print cylinder with the offset cylinder wherein the rewritable imaging surface is made from material that can be made conformal to the roughness of print media via a high pressure impression cylinder while it maintains good tensile strength necessary for high volume printing. Therefore, we disclose a system and method having the added advantage of reducing the number of high inertia drum components as compared to a typical offset printing system. The disclosed system and method may work with any number of offset ink types but has particular utility with UV lithographic inks.

The physics of modern electrical devices and the methods of their production are not absolutes, but rather statistical efforts to produce a desired device and/or result. Even with the utmost of attention being paid to repeatability of processes, the cleanliness of manufacturing facilities, the purity of starting and processing materials, and so forth, variations and imperfections result. Accordingly, no limitation in the description of the present disclosure or its claims can or should be read as absolute. The limitations of the claims are intended to define the boundaries of the present disclosure, up to and including those limitations. To further highlight this, the term "substantially" may occasionally be used herein in association with a claim limitation (although consideration for variations and imperfections is not restricted to only those limitations used with that term). While as difficult to precisely define as the limitations of the present disclosure themselves, we intend that this term be interpreted as "to a large extent", "as nearly as practicable", "within technical limitations", and the like.

Furthermore, while a plurality of preferred exemplary embodiments have been presented in the foregoing detailed description, it should be understood that a vast number of variations exist, and these preferred exemplary embodiments are merely representative examples, and are not intended to limit the scope, applicability or configuration of the disclosure in any way. Various of the above-disclosed and other features and functions, or alternative thereof, may be desirably combined into many other different systems or applications. Various presently unforeseen or unanticipated alternatives, modifications variations, or improvements therein or thereon may be subsequently made by those skilled in the art which are also intended to be encompassed by the claims, below.

Therefore, the foregoing description provides those of ordinary skill in the art with a convenient guide for implementation of the disclosure, and contemplates that various changes in the functions and arrangements of the described embodiments may be made without departing from the spirit and scope of the disclosure defined by the claims thereto.

What is claimed is:

1. A printhead subsystem for selectively removing portions of a layer of dampening fluid disposed over an arbitrarily reimageable surface in a variable data lithographic system, comprising:

a thermal printhead element disposed proximate said arbitrarily reimageable surface;

driving circuitry communicatively connected to said thermal printhead for selectively temporarily heating said thermal printhead to an elevated temperature;

whereby portions of said dampening fluid layer proximate said thermal printhead are vaporized and driven off said arbitrarily reimageable surface by said thermal printhead when said thermal printhead is at said elevated temperature to thereby form voids in said dampening fluid layer.

2. The printhead subsystem of claim 1, wherein said arbitrarily reimageable surface has a first width, and said thermal printhead has a second width at least equal to said first width.

3. The printhead subsystem of claim 1, wherein said thermal printhead element comprises a plurality of thermal printhead subelements, further wherein said arbitrarily reimageable surface has a first width, and still further wherein each said subelement has a subelement width that is less than said first width, said subelements arranged in a direction of said first width such that the entire first width is covered by said plurality of thermal printhead subelements, said subelements arranged in an alternating pattern, and each said subelement offset from one another in a direction substantially perpendicular to said first width by an offset distance relative to the position of adjacent subelements.

4. The printhead subsystem of claim 1, wherein said thermal printhead comprises:

a substrate having a proximal end and a distal end;

a thermal element carried by said substrate at said distal end;

whereby said printhead subsystem is disposed within said variable data lithographic system such that said distal end of said substrate is closer to said arbitrarily reimageable surface than said proximal end.

5. The printhead subsystem of claim 4, wherein said driving circuitry is further carried by said substrate.

6. The printhead subsystem of claim 1, wherein said thermal printhead is disposed so as to be in physical contact with said dampening fluid layer when said thermal printhead is at said elevated temperature.

7. A variable data lithography system, comprising:

an imaging member comprising an arbitrarily reimageable surface layer;

a dampening fluid subsystem for applying a dampening fluid layer to said arbitrarily reimageable surface layer;

a patterning subsystem for selectively removing portions of the dampening fluid layer so as to produce a latent image in the dampening solution, said patterning subsystem comprising;

a thermal printhead element disposed proximate said arbitrarily reimageable surface layer;

driving circuitry communicatively connected to said thermal printhead for selectively temporarily heating said thermal printhead to an elevated temperature whereby portions of said dampening fluid layer proximate said thermal printhead are vaporized and driven off said arbitrarily reimageable surface layer by said thermal printhead when said thermal printhead is at said elevated temperature to thereby form voids in said dampening fluid layer;

an inking subsystem for applying ink over the arbitrarily reimageable surface layer such that said ink selectively occupies said voids to thereby produce an inked latent image;

an image transfer subsystem for transferring the inked latent image to a substrate; and a cleaning subsystem for removing said dampening fluid layer and said ink;

said imaging member and said patterning, inking, image transfer, and cleaning subsystems moving relative to one another such that said arbitrarily reimageable surface layer is cleaned by said cleaning subsystem and a new dampening fluid layer is applied thereover by said dampening fluid subsystem.

8. The printhead subsystem of claim 7, wherein said arbitrarily reimageable surface layer has a first width, and said thermal printhead has a second width at least equal to said first width.

9. The printhead subsystem of claim 7, wherein said thermal printhead element comprises a plurality of thermal printhead subelements, further wherein said arbitrarily reimageable surface has a first width, and still further wherein each said subelement has a subelement width that is less than said first width, said subelements arranged in a direction of said first width such that the entire first width is covered by said plurality of thermal printhead subelements, said subelements arranged in an alternating pattern, and each said subelement offset from one another in a direction substantially perpendicular to said first width by an offset distance relative to the position of adjacent subelements.

10. The printhead subsystem of claim 7, wherein said thermal printhead comprises:

a substrate having a proximal end and a distal end;

a thermal element carried by said substrate at said distal end;

whereby said printhead subsystem is disposed within said variable data lithography system such that said distal end of said substrate is closer to said arbitrarily reimageable surface layer than said proximal end.

11. The printhead subsystem of claim 10, wherein said driving circuitry is further carried by said substrate.

12. The printhead subsystem of claim 7, wherein said thermal printhead is disposed so as to be in physical contact with said dampening fluid layer when said thermal printhead is at said elevated temperature.

13. An offset lithographic apparatus, comprising:

an imaging plate cylinder having an ink receiving surface;

an inking system disposed relative to said imaging plate cylinder such that ink may be applied to said ink receiving surface;

an offset blanket cylinder having an arbitrarily reimageable surface, disposed relative to said imaging plate cylinder such that ink from said ink receiving surface may be transferred to said arbitrarily reimageable surface;

a dampening fluid subsystem disposed relative to said arbitrarily reimageable surface such that a dampening fluid layer may be formed thereover;

a thermal printhead element disposed proximate said arbitrarily reimageable surface;

driving circuitry communicatively connected to said thermal printhead for selectively temporarily heating said thermal printhead to an elevated temperature;

whereby portions of said dampening fluid layer proximate said thermal printhead are vaporized and driven off said arbitrarily reimageable surface by said thermal printhead when said thermal printhead is at said elevated temperature to thereby form voids in said dampening fluid layer; and whereby ink applied from said ink receiving surface selectively occupies said voids to thereby produce an inked latent image.

14. The offset lithographic apparatus of claim 13, wherein said imaging plate cylinder comprises a variable data region and a static image region, said imaging plate being substantially blank in said variable data region, and said imaging place have an image formed in said static image region.

15. The offset lithographic apparatus of claim 14, wherein said inking subsystem is configured to produce a uniform ink layer over substantially the entirety of the variable data region, and said inking subsystem further configured to produce a selectively inked image over said static image region.

16. The offset lithographic apparatus of claim 15, wherein:

a portion of said uniform ink layer is substantially transferred to said offset blanket cylinder;

said static image from said imaging plate cylinder is substantially transferred to said offset blanket cylinder;

said dampening fluid subsystem is disposed to apply dampening fluid selectively to a region corresponding to the location of said uniform ink layer prior to the transfer of said uniform ink layer to said offset blanket cylinder; and, said thermal printhead element is disposed so as to selectively form said voids in said dampening fluid layer prior to the transfer of said uniform ink layer to said offset blanket cylinder;

such that said portion of said uniform ink layer substantially transferred to said offset blanket cylinder corresponds in location to said voids.

17. The offset lithographic apparatus of claim 16, further comprising an image transfer subsystem disposed relative to said offset blanket cylinder for transferring said ink in locations corresponding to said voids and said static image substantially transferred from said imaging plate cylinder to a substrate.

18. A variable data lithographic apparatus, comprising:

an imaging plate cylinder having an arbitrarily reimageable surface;

a dampening fluid subsystem, comprising a dampening fluid form roller, disposed relative to said arbitrarily reimageable surface such that a dampening fluid layer may be formed thereover;

a thermal printhead element disposed proximate said dampening fluid form roller;

driving circuitry communicatively connected to said thermal printhead for selectively temporarily heating said thermal printhead to an elevated temperature;

whereby portions of said dampening fluid layer proximate said thermal printhead are vaporized and driven off by said thermal printhead when said thermal printhead is at said elevated temperature to thereby form a latent image in said dampening fluid layer;

whereby said dampening fluid form roller is disposed relative to said imaging plate cylinder such that said latent image may be transfer from said dampening fluid form roller to said imaging plate cylinder;

an inking system disposed relative to said imaging plate cylinder such that ink may be applied to said arbitrarily reimageable surface; and whereby ink applied from said inking system selectively occupies said voids to thereby produce an inked latent image.

19. A method of forming a latent image over an arbitrarily reimageable surface of an imaging member for receiving ink and transfer of said ink to a substrate, comprising:

forming a dampening fluid layer over said arbitrarily reimageable surface of said imaging member;

producing said latent image in said dampening fluid layer by:

disposing a thermal printhead element proximate said arbitrarily reimageable surface layer;

driving thermal printhead to selectively temporarily heat said thermal printhead to an elevated temperature, whereby portions of said dampening fluid layer proximate said thermal printhead are vaporized and driven off said arbitrarily reimageable surface layer by said thermal printhead when said thermal printhead is at said elevated temperature to thereby form voids in said dampening fluid layer;

applying ink over said arbitrarily reimageable surface layer such that said ink selectively occupies said voids to thereby produce an inked latent image; and transferring the inked latent image to a substrate.

20. A method of retrofitting an offset printing apparatus of a type including a static image plate cylinder and an offset blanket cylinder so as to provide variable data lithographic capability, comprising:

applying an arbitrarily reimageable surface over said offset blanket cylinder;

disposing proximate said offset blanket cylinder a dampening fluid subsystem such that a dampening fluid layer may be formed over said arbitrarily reimageable surface;

disposing a thermal printhead element proximate said arbitrarily reimageable surface;

configuring a portion of said static image plate cylinder to have an ink receiving surface;

whereby portions of said dampening fluid layer proximate said thermal printhead may be vaporized and driven off said arbitrarily reimageable surface by said thermal printhead when said thermal printhead is at an elevated temperature to thereby form voids in said dampening fluid layer; and whereby ink applied from said ink receiving surface selectively occupies said voids to thereby produce an inked latent image.

21. The method of claim 20, further comprising:

configuring said imaging plate cylinder to have a variable data region and a static image region, said imaging plate being substantially blank in said variable data region, and said imaging place have an image formed in said static image region;

configuring an inking subsystem to apply a uniform ink layer over substantially the entirety of the variable data region, and to apply a selectively inked image over said static image region;

disposing said image plate cylinder and said offset blanket cylinder such that a portion of said uniform ink layer may be substantially transferred to said offset blanket cylinder, and said static image may be substantially transferred from said image plate cylinder to said offset blanket cylinder;

configuring a dampening fluid subsystem such that dampening fluid may be selectively applied to a region of said offset blanket cylinder corresponding to the location of said uniform ink layer prior to the transfer of said uniform ink layer to said offset blanket cylinder;

configuring a driver communicatively coupled to said thermal printhead such that said thermal printhead is driven to selectively form said voids in said dampening fluid layer prior to the transfer of said uniform ink layer to said offset blanket cylinder;

whereby said portion of said uniform ink layer substantially transferred to said offset blanket cylinder corresponds in location to said voids.

* * * * *